US006381908B1

(12) United States Patent
Fisher

(10) Patent No.: US 6,381,908 B1
(45) Date of Patent: May 7, 2002

(54) STUD SETTING DEVICE

(76) Inventor: Jerry A. Fisher, 205 Fair St., Moville, IA (US) 51039

( * ) Notice: Subject to any disclaimer, the term of this patent is extended or adjusted under 35 U.S.C. 154(b) by 0 days.

(21) Appl. No.: 09/583,324

(22) Filed: May 30, 2000

(51) Int. Cl.[7] ..... E04G 21/26

(52) U.S. Cl. ..... 52/127.2; 52/749.1; 52/DIG. 1; 33/613; 33/645; 33/562; 29/271; 29/464; 269/43; 269/904; 269/910

(58) Field of Search ..... 52/243, 317, 664, 52/667, DIG. 1, 749.1, 127.2; 33/613, 423, 451, 464, 533, 645, 370, 381, 562; 269/43, 41, 40, 45, 904, 905, 909, 910; 29/271, 464

(56) References Cited

U.S. PATENT DOCUMENTS

| | | | | |
|---|---|---|---|---|
| 3,963,230 | A | | 6/1976 | Janjowski, Jr. |
| D253,582 | S | | 12/1979 | Schwartz |
| 4,237,614 | A | | 12/1980 | Williams |
| 4,301,596 | A | | 11/1981 | Sedlock |
| 4,474,222 | A | | 10/1984 | Gordon |
| 4,527,337 | A | | 7/1985 | Dreiling |
| 4,625,415 | A | | 12/1986 | Diamontis |
| D290,236 | S | | 6/1987 | Custine |
| 4,795,141 | A | | 1/1989 | Mulvaney |
| 4,843,726 | A | | 7/1989 | Ward |
| 4,845,858 | A | | 7/1989 | Thomas |
| 4,944,096 | A | | 7/1990 | Tolley |
| 4,958,814 | A | | 9/1990 | Johnson |
| D314,520 | S | | 2/1991 | Hass |
| 5,129,153 | A | | 7/1992 | Burns, Sr. |
| 5,490,334 | A | | 2/1996 | Payne |
| 5,768,795 | A | | 6/1998 | Jimenez |
| 5,784,850 | A | | 7/1998 | Elderson |
| 5,884,411 | A | * | 3/1999 | Raber ..... 33/613 |
| 5,913,546 | A | | 6/1999 | Kuchenbrod et al. |
| 5,937,531 | A | | 8/1999 | Menk et al. |
| 5,960,554 | A | | 10/1999 | Kamykowski |
| 6,070,336 | A | | 6/2000 | Rodgers |

* cited by examiner

*Primary Examiner*—Carl D. Friedman
*Assistant Examiner*—Yvonne M. Horton
(74) *Attorney, Agent, or Firm*—McKee, Voorhees & Sease, P.L.C.

(57) ABSTRACT

A device for setting studs includes a rigid face plate that has a fixed length and includes a lower surface, a front edge, a rear edge, and opposite side edges; a rigid bar member extending from the face plate lower surface so as to have a rear surface perpendicular to the face plate lower surface. The face plate has first and second square inside corners formed in its rear edge for squarely aligning and setting studs a desired distance apart between centers and restricting movement thereof during fastening to a sill plate or similar structure.

13 Claims, 5 Drawing Sheets

STUD SETTING DEVICE

BACKGROUND OF THE INVENTION

The present invention relates to the field of building construction. More particularly, this invention relates to a device for assisting in the process of squarely installing wall studs and ceiling or floor joists at desired intervals in new construction or remodeling.

There are several reasons why the proper installation of studs and joists is one of the most important tasks of any construction project. First, the wall studs or joists must be installed so that the centers of adjacent studs or joists are a precise distance apart that is typically required by the architectural plans, building specifications, or building codes. In the United States, the typical distance between adjacent stud centers is either sixteen inches or twenty-four inches, and floor and ceiling joists are also typically sixteen or twenty-four inches apart on centers. Errors in setting adjacent studs or joists tend to be additive and accumulate over the length of the wall or ceiling/floor respectively. For example, a ¼ inch error per stud can result in a 40 foot wall that is several inches off its specified length.

Plywood, particleboard, paneling, and gypsum-based sheet rock, which are typical coverings used in frame construction, usually come in four-foot by eight-foot sheets. Therefore, it is very important that studs or joists are present at four-foot and eight-foot intervals, so that the edges of the coverings can be attached to the frame. The studs must also be square with the top of the sill plate so that the frame is square. The studs cannot lean or twist, and the desired interval must be maintained along the entire height of the wall. The front edge of the wall stud must align with the front edge of the sill plate or stringer. If not, a perceptible bulge or recess will appear in the finished wall. The side edge of the wall stud must also be square with the front edge of the sill plate or stringer so that the stud lays flat behind the sheet rock or whatever is attached to it.

As described briefly below, various known devices and methods have been attempted to accomplish the task of setting studs or joists. However, due to the shortcomings and impracticalities of these approaches, the most commonly used conventional technique remains measuring and marking each stud with a tape measure, measuring and marking the distance desired along the sill plate or stringer, placing the stud in the desired location, then trying to hold it with one hand while fastening it with the other hand. The stud tends to move during the fastening or nailing process, thus throwing off the measurement and alignment. Therefore, framing a building can be difficult, tedious, costly, and time consuming.

In U.S. Pat. No. 4,625,415, Diamontis discloses a stud spacer that includes a rigid support to which spacers are fixed at longitudinally-spaced intervals corresponding to the distance between studs to hold them at the desired spacing during fastening. Holes are provided at spaced intervals along the support for receiving nails for anchoring the structure to the floor stringer or sill plate. The spacers wrap around three sides of the stud being placed. This structure precludes the use of the device in remodeling construction, where the studs must be set tight against an existing wall. Furthermore, this feature also prevents the use of the device for setting the first wall stud and requires measuring with a tape measure or other scale to set the second wall stud. This tool is also not shown to be versatile or adjustable, which means that multiple tools will be required to set studs at the various different stud, spacing distances required by building codes, etc. The tool must be fastened to the floor or sill plate before setting each successive wall stud. This requires installing and removing nails every time, which is time consuming. Contractors, who are always looking to save time and cost on projects, may not want to expend the time to use this particular tool. Since the device wraps around three sides of the stud, installation of 2×6, 2×8, 2×10 and 2×12 studs or joists would require the purchase of separate tools for each size. The use of this device prevents the user from nailing the front and left side of the stud because of its design. To nail the above-mentioned sides, the device must be removed first, which defeats the purpose of the tool in securing the wall stud while nailing.

In U.S. Pat. No. Des. 314,520, Hass discloses a construction stud layout tool. This device is clearly dedicated to a particular spacing between the studs and must be left in place as a permanent part of the structure after the studs are set. Thus, this device is not reusable and would add significantly to the cost of the building under construction. Furthermore, the partitions between which the stud is placed interfere with two possible sites for nailing the stud to the sill plate.

In U.S. Pat. No. 4,843,726, Ward discloses a stud alignment and positioning tool. This large and bulky device requires the worker to temporarily secure the tool to a plurality adjacent studs with nails or screws at every stud. Most construction workers are under time and cost pressures, so they may be disinclined to use this tool. Furthermore, this tool does not align the front of the stud to the sill plate, which is essential if the sheet rock is to lie flat against it.

In U.S. Pat. No. 4,795,141, Mulvaney discloses a rather complex cam locked stud-nailing fixture. This device is a temporary clamp only and cannot be used to measure the distance between the studs. The worker still needs to measure and install the device on the sill plate for every individual stud. This is very slow and time-consuming. Like the Diamontis device, this device engages the rear of the sill plate and therefore cannot be used on remodeling projects where access to the rear of the sill plate is impossible.

Various other devices that merely measure but do not restrain the studs for nailing are disclosed in the following patents: Jimenez U.S. Pat. No. 5,768,795; Kamykowski U.S. Pat. No. 5,960,554; Sedlock U.S. Pat. No. 4,301,596; and Dreiling U.S. Pat. No. 4,527,337.

There is a need for a better device for setting studs and joists. Therefore, a primary objective of the present invention is the provision of a device for setting studs and joists that is accurate, reliable and convenient to use.

Another objective of this invention is the provision of a stud setting device that can be used to set floor or ceiling joists.

Another objective of this invention is the provision of a single stud setting device that can be used on various sizes of studs and joists, including but not limited to two-by-fours (2×4s), 2×6s, 2×8s, 2×10s and 2×12s.

Another objective of this invention is the provision of a stud setting device that can be used to set the first stud (or a corner stud if there is a second perpendicular sill plate to abut to) and the next stud adjacent to the corner.

Another objective of this invention is the provision of a single stud setting device that can set studs on sixteen inch or twenty-four inch centers.

Another objective of this invention is the provision of a stud setting device that has a low profile to essentially allow access to all four sides of the stud so that it can be anchored with nails or other fasteners driven in at angles from any of said sides without removing the device.

Another objective of this invention is the provision of a stud setting device that securely retains the stud in the desired position during the fastening or nailing of the stud to the sill plate.

Another objective of this invention is the provision of a stud setting device that is able to take a twist out of a warped or twisted stud.

Another objective of this invention is the provision of a stud setting device that is relatively simple and inexpensive to produce.

These and other objectives will be apparent from the drawings, as well as from the description and claims that follow.

SUMMARY OF THE INVENTION

The present invention relates to a device for restraining and setting studs a desired distance apart between centers. The stud setter is simple to construct and can be formed as a single unitary piece or a multiple piece assembly. The stud setter includes two main functional components: a rigid face plate and a bar member extending therefrom or attached thereto. The face plate has upper and lower surfaces, a front edge, a rear edge, and opposite side edges. The bar extends from the lower surface of the face plate and defines a plane that extends perpendicular to the lower surface of the face plate. The face plate further includes oppositely directed first and second square inside corners formed in its rear edge for spacing studs at a desired distance between centers and restricting movement of the studs as they are fastened to a sill plate or similar structure.

The basic device, its use, and a more versatile multiple interval reversible device are disclosed herein.

DETAILED DESCRIPTION OF THE PREFERRED EMBODIMENTS

For the purposes of this description, the terms "stud" and "joist" are generally used interchangeably. By far the most common stud used in housing construction in the United States is known as the two-by-four. While this stud has a nominal designation of 2 inches by 4 inches, it is well known in the construction art that the actual dimensions of such studs in a transverse plane are 1.5 inches by 3.5 inches. Thus, the center of a two-by-four stud is found 0.750 inches inward along its shorter side in a transverse plane. Because they all share the same common width, 2×6, 2×8, 2×10, 2×12 studs have centers at the same location.

Figure 6:
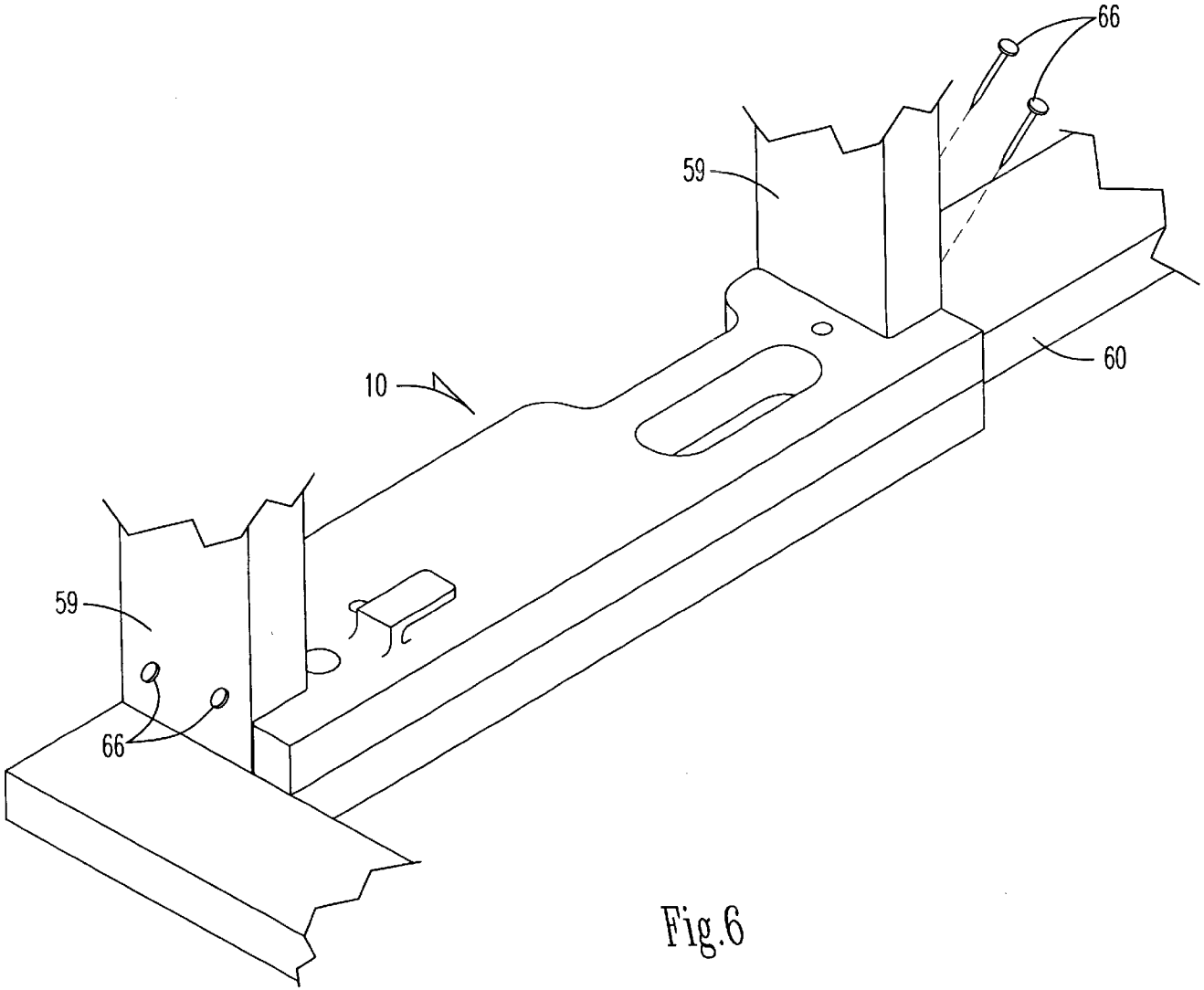
FIG. 6 is an isometric view of the stud setting device of FIG. 1 in use.

As shown in FIGS. 1–4 and 6, the stud setting device 10 of this invention includes an elongated and substantially rigid face plate 12 and a bar member 14 extending from or attached thereto in a perpendicular manner. The faceplate 12 has an upper surface 16, a flat planar lower surface 18, a rear edge 20, a front edge 22, and opposite end edges 24, 26, when oriented as shown in FIG. 6. Preferably, the end edges 24, 26 extend perpendicular to the lower surface 18. The bar member 14 is a substantially rigid elongated bar extending from or rigidly attached to the lower surface 18 of the face plate 12. The bar member 14 is disposed between the front and rear edges 22, 20 of the face plate 12, and more preferably as shown in FIGS. 1–4, the bar member 14 has front edge 28 that may or may not be coplanar with the front edge 22 of the face plate 12. Ideally, the rear edge 30 of the bar member 14 is flat, planar and perpendicular to the lower surface 18 of the face plate 12. The bar member 14 also includes an upper surface 32, a lower surface 34 and opposite end edges 36, 38 (see FIG. 3).

A first square inside corner 40 is formed on the rear edge 20 of the face plate 12 and defined by a first L-shaped notch or cutout of the rear edge 20. The first L-shaped notch includes a first flat surface 42 that is at least parallel with (and preferably coplanar to) the flat rear surface 30 of the bar member 14. The first L-shaped notch or corner 40 further includes a second flat surface 44 that is perpendicular to both the first surface 42 and the flat rear surface 30 of the bar member 14. A second square inside corner 46 is formed on the rear edge 20 of the face plate 12 and defined by a second L-shaped cutout of the rear edge 20. The second L-shaped cutout includes a first flat surface 48 that is parallel (and preferably co-planar) with the flat rear surface 30 of the bar member 14. The second L-shaped cutout further includes a second flat surface 50 that is perpendicular to both the first surface 48 and the flat rear surface 30 of the bar member 14. The second inside corner 46 is formed a predetermined distance from the first square inside corner 40 along the length of the face plate 12. For example, to accommodate the usual spacing desired between studs in residential construction in the United States, the second square inside corner 46 can be located 14.5 inches from the first square inside corner 40. This allows the studs to be placed 16 inches apart on center. It is important to note that the second surface 50 of the second inside square corner 46 is directed in a 180 degree opposite direction from the second surface 44 of the first square inside corner 40. Thus, movement of the stud setting device 10 is prevented by the first square inside corner abutting the first stud set, as shown in FIG. 6. The movement of the device 10 can also be limited in one direction by one of the end edges 24, 26 or 36, 38 abutting another wall, stud, or sill plate. The end edges 24, 26 are preferably parallel to and, more preferably, coplanar with the respective end edges 36, 38. The end edges 36, 38 are also parallel to each other.

As best seen in FIG. 6, the second surfaces 44, 50 are at least as short in length as the transverse length of the stud being set. In the case of a two-by-four, the second surfaces 44, 50 should be less than or equal to 3.50 inches in length, more preferably, about 3.25 inches. For other studs, the length of the second surfaces 44, 50 could preferably be about ¼ inch less than the long side of the stud in a transverse plane, but other lengths will suffice. The length of the first surfaces 42, 48 preferably closely corresponds to the width in a transverse plane of the stud being set. In the case of boards having a nominal width of 2.0 inches, the actual width of these boards is 1.5 inches. Therefore, the first surfaces 42, 48 preferably extend 1.5 inches perpendicularly outward from the respective second surfaces 44, 50.

A plurality of hash marks or visibly discernable indicia for measuring are provided on the upper surface 16 of the face plate 12. Preferably, these indicia are at least placed at intervals that correspond to the desired distance between the studs being set. For example, in the basic device shown in FIGS. 1–4, the major markings or indicia appear at least every 16 inches. A plurality of optional sub-interval or minor markings can be provided, if desired. Of course, the major markings can be varied to meet specifications, local building codes or practices.

A clip 52 is provided on the device 10 for mounting it to the user's belt or clothing. The clip is preferably an L-shaped member that protrudes from the upper surface 16 of the face plate 12. However, the clip 52 can be placed in other locations on the device 10 without detracting from the present invention. The stud setting device 10 also includes a handle 54 attached thereto. Preferably, the handle 54 extends between and is delimited by an opening 53 in the face plate 12 and a recess 55 in the rear surface 20. The opening 53 and the recess 55 are large enough to accommodate the user's thumb and/or fingers.

A plurality of holes 56 extend through the face plate 12. The holes 56 are adapted to receive conventional fasteners, such as nails (not shown), for temporarily securing the device 10 to the sill plate 60, if desired, while the studs or joists 59 are being set. Gravity and the unique design of the stud setter 10 generally make it unnecessary to nail the device to a floor-mounted sill plate, but the holes 56 are useful when studs or floor joists are being set overhead. An optional hole 58 can be provided for hanging the device on a pegboard or nail when not in use.

As shown in FIG. 6, the basic stud setting device 10 is positioned in abutment with an existing corner, a previously fastened stud 59, or in registration with a previously measured marking on the sill plate 60 or similar structure. The surface 30 on the bar member 14 abuts the front edge of the sill plate 60, while the lower surface 18 of the face plate 12 abuts the top of the sill 60. If a solid structure is not available as a starting point to laterally position the device 10 against, one can fasten the device 10 to the sill plate 60 by a conventional quick release construction hand clamp or with conventional fasteners through holes 56. Then conventional fasteners 66, such as staples, screws, and/or nails for example, are driven in at angles to fasten the studs 59 to the sill plate 60. Preferably, the fasteners 66 are driven into the studs 59 initially from a direction opposing the respective second surfaces 44 and 50. One advantageous feature of the stud setter 10 is its low profile (1.5 inches or less, preferably less than 1 inch, and more preferably approximately ¾ inch). Two edges 42, 44 or 48, 50 engage two sides of the stud 59 being set. In addition to leaving the other two sides of the stud 59 unobstructed for nailing purposes, the height of the stud setter 10 at the two stud engaging edges is below the typical proper nailing height. This allows nailing or fastening of the stud 59 from any or all of its four sides if not restricted by some other barrier. The fasteners 66 can be driven-in at an angle without having to remove the device from the sill plate 60.

It will be appreciated by one skilled in the art that at least three points can define a plane and that three points of contact may suffice instead of flat and fully planar surfaces at 30, 44, 50, etc., so long as squareness or perpendicularity is maintained in functional locations. Excess material can also be removed at non-functional locations to minimize material, weight, cost, and facilitate plastic injection molding of the device as a single continuous and integrally formed unit. Alternatively, the device of this invention can be constructed of wood, metal, or any other rigid material. Because the present invention does not depend on the use of a particular type of fastener being used to secure the studs, it can be used to set studs formed of wood, metal, combinations thereof, or other commercially available materials.

Figure 1:
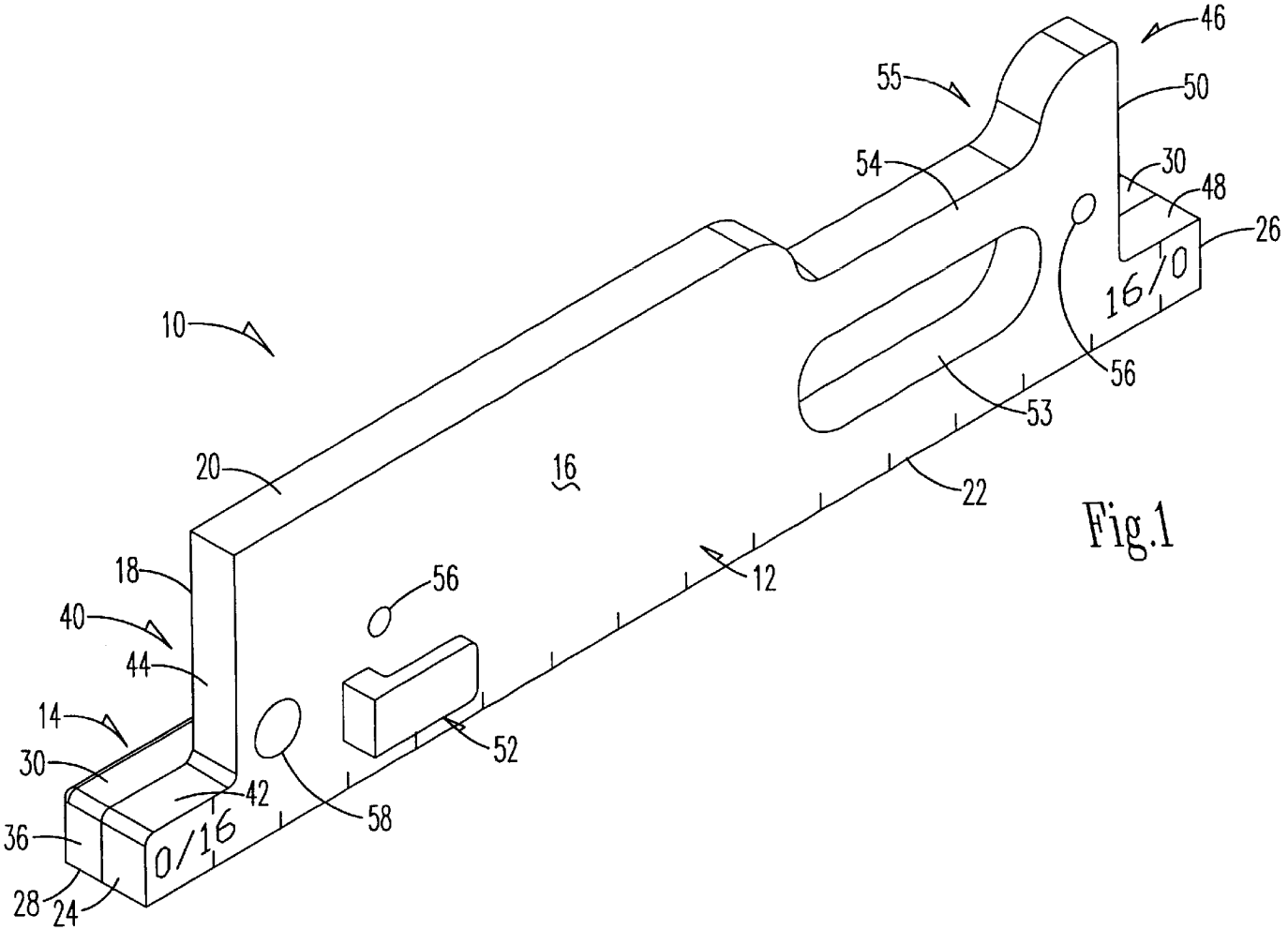
FIG. 1 is an isometric view of a first embodiment of the stud setting device of the present invention.
Figure 2:
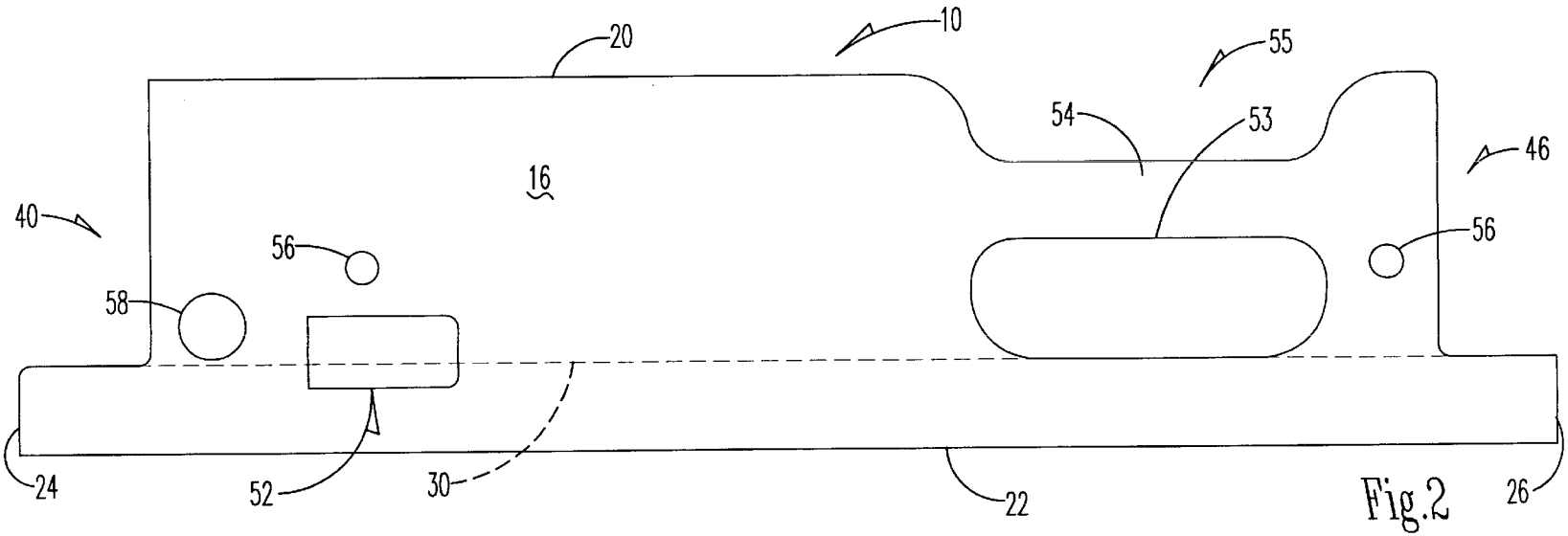
FIG. 2 is a front elevation view of the device of FIG. 1.
Figure 3:
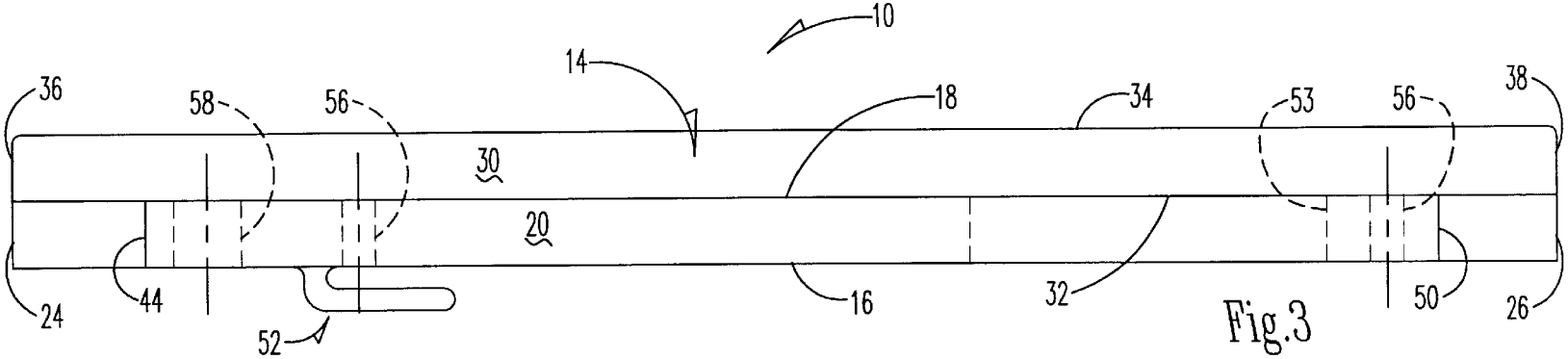
FIG. 3 is a top plan view of the device of FIG. 1.
Figure 4:
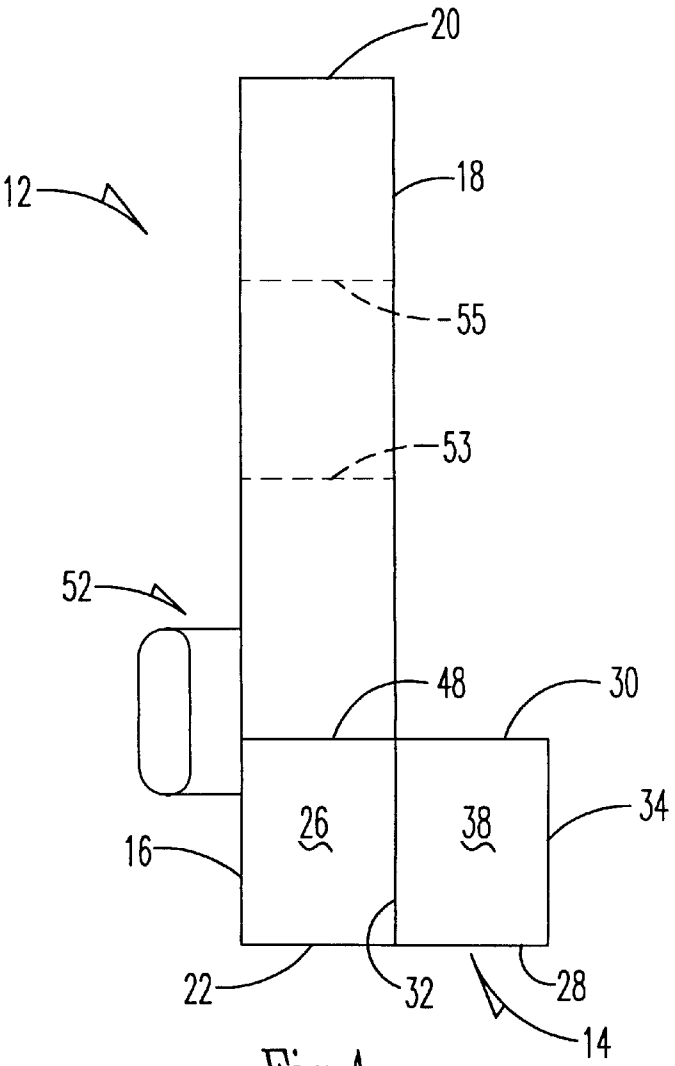
FIG. 4 is a right end elevation view of the device of FIG. 1.
Figure 5:
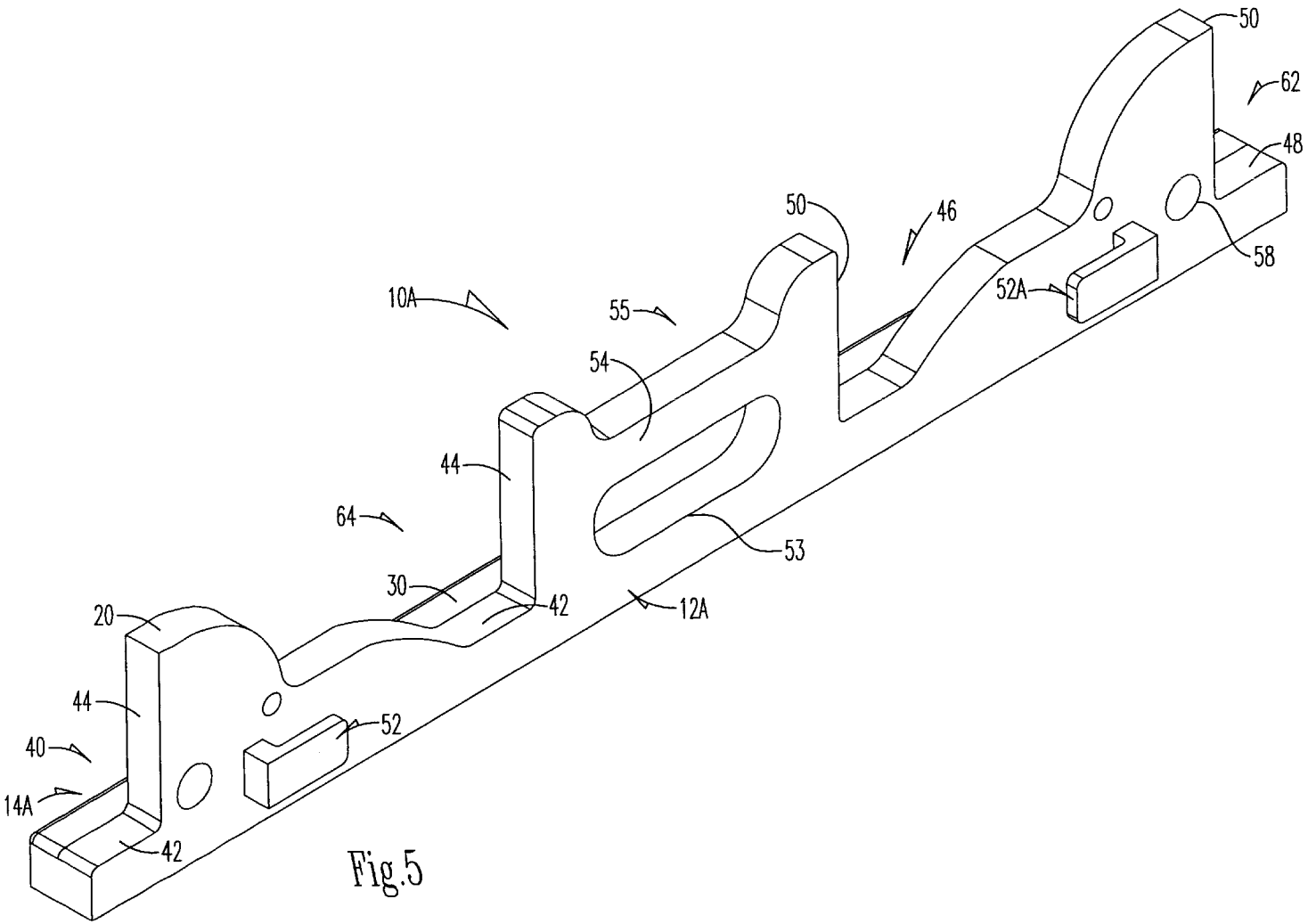
FIG. 5 is an isometric view of a second embodiment of this invention wherein multiple stud setting intervals are provided for on the same device.

Another embodiment 10A of this invention (with a face plate 12A and a bar member 14A) is shown in FIG. 5. In this embodiment, additional third and fourth square inside corners 62, 64 are provided at predetermined intervals from the first square inside corner 40. For example, the third and fourth corners 62, 64 can be placed 22.5 inches and 8.0 inches from inside corner 40, such that studs can be set 16 or 24 inches apart on centers from either end of the device (i.e.—the device is reversible). An optional second clip 52A may be provided on the face plate 12A, as shown. The second clip 52A opposes and is remote from the first clip 52, but can be utilized for the same function.

In the drawings and specification, there has been set forth a preferred embodiment of the invention, and although specific terms are employed, these are used in a generic and descriptive sense only and not for the purpose of limitation. Changes in the form and the proportion of parts as well as in the substitution of equivalents are contemplated as circumstances may suggest or render expedient without departing from the spirit or scope of the invention as further defined in the following claims.

What is claimed is:

1. A device for setting elongated studs having in transverse plane a given fixed length and a given fixed width, the device comprising:

an elongated rigid face plate having a fixed length and including an upper surface, a lower surface, a front edge, a rear edge, and opposite end edges; the lower surface defining a first locating plane; and an elongated rigid bar member extending from the lower surface of the face plate and including a rear surface residing in a second locating plane that is perpendicular to the first locating plane;

a first square inside corner being formed on the rear edge of the face plate and being defined by a first L-shaped notch in the rear edge, the first L-shaped notch including a first surface and a second surface operatively intersecting the first surface at a ninety degree angle;

the first surface residing in a third locating plane that is perpendicular to the first locating plane and parallel to the second locating plane;

the second surface residing in a fourth locating plane that is perpendicular to both the first locating plane and the second locating plane;

a second square inside corner being formed on the rear edge of the face plate and being defined by a second L-shaped notch in the rear edge, the second L-shaped notch including a first surface and a second surface operatively intersecting the first surface of the second L-shaped notch at a ninety degree angle;

the first surface residing in a fifth locating plane that is perpendicular to th first locating plane and parallel to the second locating plane;

the second surface residing in a sixth locating plane that is perpendicular to both the first locating plane and the second locating plane;

the second inside corner being formed a predetermined distance from the first inside corner along the length of face plate;

the second surface of the second inside corner being directed in a 180 degree opposite direction from the second surface of the first inside corner; and a third square inside corner identical to the second inside coiner and being formed in the rear edge of the face plate a given distance from the first inside corner that is greater than the predetermined distance between the first inside corner and the second inside corner.

2. The device of claim 1 comprising a fourth square inside corner identical to the first inside corner and being formed in the rear edge of the face plate a given distance from the third inside corner that is the same as the predetermined distance between the second inside corner and the first inside corner.

3. The device of claim 1 wherein the first surface of the first corner extends a distance from the second surface of the first corner equal to the full width of the stud before terminating at an end edge of the face plate.

4. The device of claim 3 wherein the distance the first corner extends is 1.5 inches.

5. The device of claim 1 comprising a handle attached to the face plate, the handle being integrally formed with the face plate, the handle extending between and thereby being delimited by an oblong opening formed through the face plate and a recess formed in the rear surface of the face plate.

6. The device of claim 1 wherein a clip protrudes from the face plate for detachably mounting the device to a user's belt.

7. The device of claim 6 wherein the clip is an L-shaped flange that is integrally formed with and protrudes from the face plate.

8. A device for setting elongated studs having in transverse plane a given fixed length and a given fixed width, the device comprising:

an elongated rigid face plate having a fixed length and including an upper surface, a lower surface, a front edge, a rear edge, and opposite end edges; the lower surface defining a first locating plane; and an elongated rigid bar member extending from the lower surface of the face plate and including a rear surface residing in a second locating plane that is perpendicular to the first locating plane;

a first square inside corner being formed on the rear edge of the face plate and being defined by a first L-shaped notch in the rear edge, the first L-shaped notch including a first surface and a second surface operatively intersecting the first surface at a ninety degree angle;

the first surface residing in a third locating plane that is perpendicular to the first locating plane and parallel to the second locating plane;

the second surface residing in a fourth locating plane that is perpendicular to both the first locating plane and the second locating plane;

a second square inside corner being formed on the rear edge of the face plate and being defined by a second L-shaped notch in the rear edge, the second L-shaped notch including a first surface and a second surface operatively intersecting the first surface of the second L-shaped notch at a ninety degree angle;

the first surface residing in a fifth locating plane that is perpendicular to the first locating plane and parallel to the second locating plane;

the second surface residing in a sixth locating plane that is perpendicular to both the first locating plane and the second locating plane;

the second inside corner being formed a predetermined distance from the first inside corner along the length of face plate;

the second surface of the second inside corner being directed in a 180 degree opposite direction from the second surface of the first inside corner; and the bar member having a fixed length the same as the fixed length of the face plate.

9. A device for setting elongated studs having in transverse plane a given fixed length and a given fixed width, the device comprising:

an elongated rigid face plate having a fixed length and including an upper surface, a lower surface, a front edge, a rear edge, and opposite end edges; the lower surface defining a first locating plane; and an elongated rigid bar member extending from the lower surface of the face plate and including a rear surface residing in a second locating plane that is perpendicular to the first locating plane;

a first square inside corner being formed on the rear edge of the face plate and being defined by a first L-shaped notch in the rear edge, the first L-shaped notch including a first surface and a second surface operatively intersecting the first surface at a ninety degree angle;

the first surface residing in a third locating plane that is perpendicular to the first locating plane and parallel to the second locating plane;

the second surface residing in a fourth locating plane that is perpendicular to both the first locating plane and the second locating plane;

a second square inside corner being formed on the rear edge of the face plate and being defined by a second L-shaped notch in the rear edge, the second L-shaped notch including a first surface and a second surface operatively intersecting the first surface of the second L-shaped notch at a ninety degree angle;

the first surface residing in a fifth locating plane that is perpendicular to the first locating plane and parallel to the second locating plane;

the second surface residing in a sixth locating plane that is perpendicular to both the first locating plane and the second locating plane;

the second inside corner being formed a predetermined distance from the first inside corner along the length of face plate;

the second surface of the second inside corner being directed in a 180 degree opposite direction from the second surface of the first inside corner; and the face plate having a low height profile when resting on its lower surface such that fastening means can be angled into the studs from above the face plate so as to secure the studs to a sill plate without removing the device first.

10. The tool of claim 9 wherein the height of the face plate is less than one inch.

11. The tool of claim 10 wherein the height of the face plate is approximately ¾ inch.

12. A stud spacing tool comprising:

means for spacing adjacent studs a predetermined distance apart, parallel to each other, and at right angles to a sill plate; and means for frontally aligning said adjacent studs along a full width of said studs with said sill plate.

13. The tool of claim 12 wherein the spacing means has a lower surface for contacting the sill plate and an upper surface opposite the lower surface, the upper surface having a plurality of measuring marks thereon a predetermined distance apart, whereby said marks are easily visible from above.

* * * * *